United States Patent [19]

Walker

[11] 3,979,009

[45] Sept. 7, 1976

[54] CONTAINER BOTTOM STRUCTURE

[75] Inventor: Charles E. Walker, Walnut Creek, Calif.

[73] Assignee: Kaiser Aluminum & Chemical Corporation, Oakland, Calif.

[22] Filed: Oct. 17, 1975

[21] Appl. No.: 623,271

Related U.S. Application Data

[63] Continuation-in-part of Ser. No. 560,456, March 21, 1975, abandoned.

[52] U.S. Cl. ..... 220/66; 220/70

[51] Int. Cl.[2] ..... B65D 7/42

[58] Field of Search ..... 220/66, 67, 70; 215/1 C

[56] References Cited

UNITED STATES PATENTS

| | | | |
|---|---|---|---|
| 1,963,795 | 6/1934 | Lang | 220/66 |
| 2,971,671 | 2/1961 | Shakman | 220/66 |
| 3,043,461 | 7/1962 | Glassco | 220/70 X |
| 3,142,409 | 7/1964 | Ross | 220/66 X |
| 3,409,167 | 11/1968 | Blanchard | 220/66 |
| 3,434,626 | 3/1969 | Kinslow, Jr. | 220/66 |
| 3,441,170 | 4/1969 | Khoury | 220/66 |
| 3,690,507 | 9/1972 | Gailus et al. | 220/70 x |
| 3,799,388 | 3/1974 | Knize | 220/66 X |
| 3,814,279 | 6/1974 | Rayzal | 220/66 |
| 3,878,963 | 4/1975 | Knize | 220/66 |
| 3,904,069 | 9/1975 | Toukmanian | 220/70 X |
| 3,905,507 | 9/1975 | Lyu | 220/66 |

FOREIGN PATENTS OR APPLICATIONS

| | | | |
|---|---|---|---|
| 1,061,643 | 7/1959 | Germany | 220/66 |
| 532,675 | 11/1954 | Italy | 220/66 |
| 528,006 | 10/1940 | United Kingdom | 220/66 |

*Primary Examiner*—William Price
*Assistant Examiner*—Stephen Marcus
*Attorney, Agent, or Firm*—Paul E. Calrow; John S. Rhoades

[57] ABSTRACT

Improved bottom for a seamless metal container body wherein the central portion of the bottom that includes a stiffening embossment is joined to the other portions of the bottom in an improved manner by a hinge-like section that permits selected and controlled outward flexing or bulging of the bottom when the container is sealed and subjected to internal pressures developed by the contents of the container. Despite such outward flexing of the bottom, the container still is provided with a stable bottom to rest upon in its sealed and pressurized condition.

21 Claims, 5 Drawing Figures

CONTAINER BOTTOM STRUCTURE

RELATED APPLICATION

This application is a continuation-in-part of my prior application Ser. No. 560,456, filed Mar. 21, 1975, now abandoned.

BACKGROUND OF THE INVENTION

The present invention relates to metal container bodies and more particularly to metal container bodies of the seamless variety comprised of a sidewall and a bottom formed integrally therewith. The container bottom has an improved design to provide for controlled flexing and distention of the same outwardly under the influence of internal pressures generated by the contents of the container or can after it has been closed and sealed.

In the past, a standard solution to the problem of providing a seamless metal can body, such as an aerosol, beer or carbonated beverage can body, with a bottom structure having the requisite strength or internal pressure-resistant qualities, has called for making substantially the entire bottom of such a can body in the form of a dome-type panel that was recessed inwardly. Containers provided with this general type of bottom structure are illustrated in such prior art patents as U.S. Pat. Nos. 2,777,125; 3,029,507; 3,360,158; 3,416,702; 3,232,260; 3,730,383; 3,731,838; 3,693,828; 3,556,032; 3,603,275; 3,701,455; 3,782,315 and 3,785,311. Alternately, seamless can bottoms have been provided with conventional reinforcing beads or rings, such as are provided in the seamless metal cans discussed at pages 26–31 of the Mar., 1952, issue of the magazine entitled "Modern Metals" and at pages 20–23 of the Feb., 1959 issue of the magazine entitled "Florida Trend," and U.S. Pat. No. 3,312,098.

When a seamless metal can body having such a bottom structure was fabricated in the past as, for example, that of U.S. Pat. No. 3,693,828, only the outer periphery of the can bottom was adapted to contact the surface upon which the can rested whereby the can had a substantial amount of stability in either a filled or empty condition.

Despite the strength and stability provided by the inwardly recessed and domed bottom in a seamless can body structure, such a bottom ordinarily required a substantial metal thickness in the starting metal blank so as to provide the requisite reservoir of metal for properly forming the bottom and the adjacent sidewall section in order to avoid deleteriously thinning of the bottom or adjacent section of the sidewall in one or more areas to the point that localized weakened areas resulted and the strength otherwise provided by the domed bottom configuration was nullified.

Another disadvantage incident to the use of prior art seamless can bodies provided with domed bottoms concerns the fact that the deeper or larger the dome, the greater the volumetric loss in the interior of the can. This volumetric loss had to be compensated for either by increasing the length of the can sidewall and/or can diameter with the consequent use of additional starting metal.

More recently, in an effort to utilize less metal material and effect a savings in container cost, while at the same time still utilizing a spherically or hemispherically domed bottom design for the purposes of reinforcing the bottom of a seamless metal can body, efforts have been made to provide a relatively deep or large reinforcing dimple or bubble in the central portion of the seamless can bottom and a relatively flattened area in the outer reaches of such bottom. When a can body provided with such a bottom was filled and sealed with a liquid under pressure, such as beer or a carbonated beverage, the can bottom was permitted to flex or bulge out in a selective fashion in a ring-like area adjacent the bubble. In other words, the can bottom rather than resisting pressure was allowed to flex outwardly in the direction of the pressure applied thereto. Such a can, for example, is shown and discussed at page 96 of "Business Week" magazine for Nov. 23, 1974, and in U.S. Pat. No. 3,904,069, issued Sept. 9, 1975.

Even in this latter type of can bottom structure, however, because of the relatively large size of the bubble used in the can bottom as commercially manufactured and discussed in the aforementioned Business Week magazine article, and when compared to the overall bottom surface area of the can and because of the decrease in capacity incident thereto, a substantial amount of metal is still required in the final can body structure even though less starting material may be used than that in the past. In other words, it can still be necessary to provide an adequate reservoir of metal for lengthening or increasing the diameter of the can sidewall as noted previously in order to compensate for loss of capacity plus the fabrication of a bubble or dome of the proper metal thickness and strength. Thus, this last noted can bottom structure as well as other and similar can bottom structures as shown in U.S. Pat. Nos. 3,369,694; 3,272,383; 3,359,841 and 3,572,271 can still be objectionable as regards the amount of material required for the bottom and sidewall structures to obtain the requisite strength, volume, etc.

The instant invention is concerned with providing a seamless metal can that is particularly advantageous as regards its being used to dispense liquids maintained under pressure. It has an improved bottom structure that can be made with a minimal metal thickness consistent with other strength and volume requirements. The instant container is also believed to have a relatively stable bottom when filled with pressurized fluid, and even when flexed or distended in the controlled manner to be described. The improved configuration of the container bottom of the instant invention is such that where the container is a drawn and ironed container it can be readily formed in the tool pack of a standard draw and iron can bodymaker and at the end of the ironing operation so that no separate and costly doming operation need be used.

SUMMARY OF THE INVENTION

In providing an improved bottom for a seamless metal can body in accordance with the instant invention, the central portion of the bottom of the can is provided with a relatively shallow, inwardly depressed dome or button-like section that can have the configuration of a spheroid or spherical segment. The peripheral edge of this depressed section advantageously terminates in a somewhat upwardly and outwardly inclined ring-like dished section and the outer extremity of this dished section merges with a generally planar, ring-like section that also can project in a somewhat upwardly and outwardly direction until it ultimately terminates in and is integrally joined with the sidewall of the can. This planar section constitutes at least a substantial and preferably a major part of the total surface area of the can bottom. The point of mergence of the dished section and the generally planar section is preferably comprised of a selectively thinned and work hardened, coined portion that has distortion-resistant, hoop-like strength characteristics. This coined portion advantageously acts in the manner of a stiff hinge about which the central part of the can bottom comprised of a dished section and button-like depression controllably pivots outwardly until an edge of the dished section protrudes or extends slightly beyond what constitutes the outermost plane of the outer surface of the planar section, when the can bottom including the central part of the can bottom flexes in the manner of a spring and is distended outwardly under the influence of internal pressures generated by the can's contents.

Since the dome or button-like depression is relatively shallow, compared to prior art practices, no severe draw forming is required to provide the same and less overall metal is needed to avoid deleterious and excessive bottom wall and adjacent side-wall section thinning. Such a bottom structure still has sufficient strength characteristics to adequately meet the various internal pressure requirements for commercially acceptable cans and, in particular, those designed for beer and carbonated beverages.

The relatively shallow depth of the dome-like depression and other adjacent shaped parts of the can bottom structure of the instant invention also avoids the severe interior volume losses and the necessity of increasing sidewall length and/or can cross-sectional dimension to make up for such losses. The net result when applied to a significant number of cans means substantial metal and cost savings.

In the controlled flexing of the seamless container or can bottom of the instant invention, when the top free edge of the can is double seamed and sealed to a conventional end or to an end provided with easy open features and then subjected to internal bulging pressures, sufficient surface-to-surface contact is still provided between the central part of the can bottom and a support for the can to be effectively stabilized and resist tippage. When the can is opened and internal pressure relieved, the bottom of the can will relax and, in seeking to return to its original as-fabricated shape will seek to contact the support over an increased circumferential area and thus be further stabilized.

Although a seamless metal container body embodying the features of the instant invention can be made from various metals, e.g. ferrous metals such as steel, tin plate and black plate, it will be discussed in the ensuing description with particular reference to being manufactured from a light metal, such as aluminum, including hard and extra hard tempered alloys thereof.

DETAILED DESCRIPTION

Figure 2:
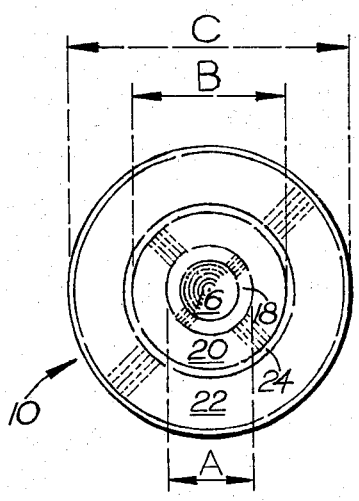
FIG. 2 is a plan view of the bottom of the container shown in FIG. 1 when taken along line 2—2 thereof.

With further reference to the drawings, a seamless metal container body, such as the cylindrical seamless metal container body 10, that embodies the features of the instant invention, can be advantageously made in the form of a work hardened drawn or drawn and ironed metal container, e.g. an aluminum container produced on a draw and iron press of the type illustrated, for example, in U.S. Pat. Nos. 3,289,453 or 3,496,756, or it can be an aluminum impact extruded container or the like. When container body 10 is produced on a draw and iron press, can bottom 12 integrally connected to the sidewall 14 can be shaped on a standard and appropriate bottom doming device located at the exit end of the press tooling. As indicated particularly in FIGS. 2 through 4, container bottom 12 is comprised of a relatively shallow, central and inwardly disposed dome-like depression 16 that can be spheroidal, frusto-conical, or in one preferred embodiment of the invention it can have a configuration that approximates the segment of a sphere. The lower peripheral wall section of button-like depression 16 can be advantageously made in the form of a relatively planar wall supporting segment 18 or simply the continuation of the arcuate shape.

Figure 3:
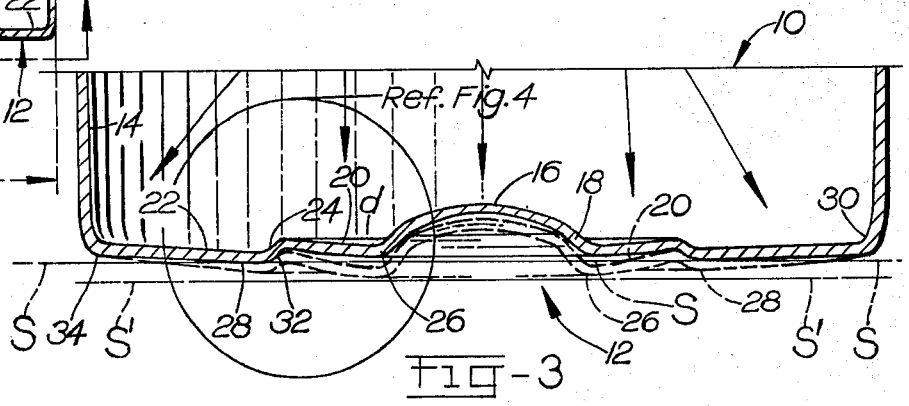
FIG. 3 is a sectional view of the bottom and lower sidewall of the container body of FIG. 1 when taken along line 3—3 thereof and with the as-fabricated shape of the bottom being shown in full lines and its shape when flexed under pressure being shown in dotted lines.

As indicated in FIG. 3, wall segment 18 is arranged at an appropriate inside angle *d*, e.g. on the order of between 95° to 100° to the adjacent dish-shaped and ring-like section 20 to which it is joined. Dish-shaped section 20 in the as-fabricated can bottom structure of FIG. 3 projects outwardly away from depression 16 and wall section 18 and in a slightly upward direction until it merges with and is connected to a generally planar bottom section 22 in the outer reaches of the bottom 12 by way of the wall connecting section 24. Section 22 ultimately is connected to the container sidewall 14 and this planar section 22 constitutes a substantial and preferably a major part of the total area of the bottom 12. For example, it can constitute as much as 55 to 75% of the overall bottom surface area of the container body. In one advantageous embodiment of the invention, section 22 can have a slight downward inclination of a few degrees in its as-fabricated condition relative to sidewall 14 so that it projects slightly downwardly and inwardly from sidewall 14 and conversely slightly upwardly and outwardly relative to section 20 as noted in FIGS. 3 and 4 instead of being disposed at a 90° angle relative to the sidewall 14.

Figure 1:
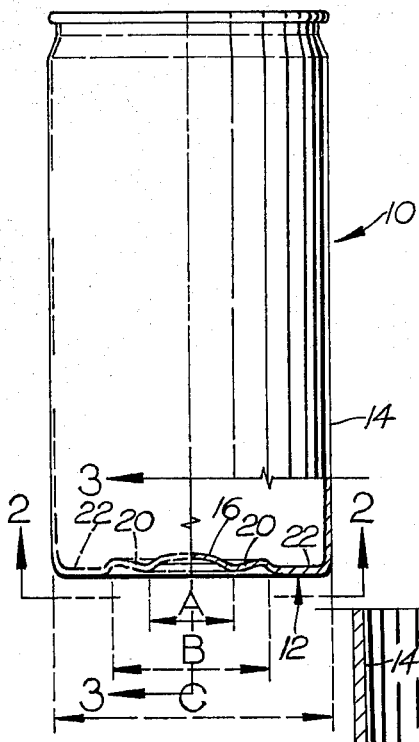
FIG. 1 is a partially sectioned and elevational view of an empty seamless container body embodying the features of the instant invention.

The point of mergence 24 of the dish-shaped section 20, the latter of which can have a somewhat inverted frusto-conical shape, is comprised of a somewhat cross-sectionally and inwardly curved, stepped and selectively work hardened and thinned coined portion having distortion resistant, hoop-like strength characteristics. The thinnest portion of section 24 preferably occurs at the point of juncture between section 24 and section 20. As indicated particularly in FIG. 4, this same stepped and coined portion during the bottom forming operation is selectively deformed beyond the elastiic limit of the metal in bottom 12 so as to set and position dished section 20 in a substantially fully retracted position relative to the bottom surface 28 of planar section 22 in the empty and as-fabricated can body of FIGS. 1 and 3. This same somewhat curved and coined portion 24, on the other hand, advantageously acts as a relatively stiff hinge about which the central part of the container bottom, which includes dished section 20 and the shallow dimple 16 can flex and become distended outwardly under the influence of the internal pressure generated by the container's contents, etc. when the container has been sealed, so that the primary annular stabilizing ring portion 26 formed at the junction of can bottom sections 18 and 20 can then protrude slightly beyond the outermost plane S that can be projected by the lowest point on the outer surface 28 of section 22 and serve as a can support base, all as indicated particularly in FIGS. 3 and 4.

Figure 4:
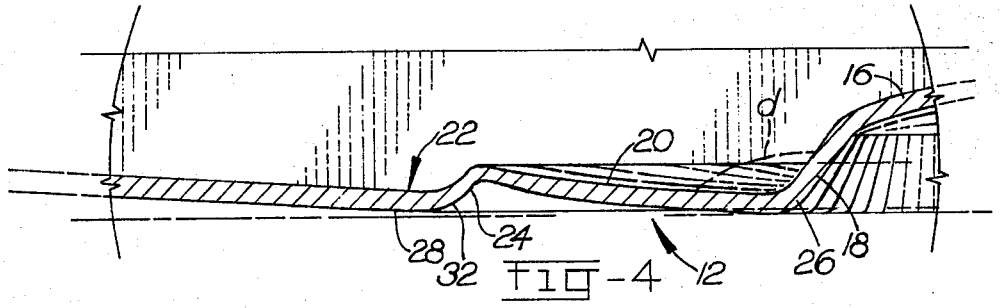
FIG. 4 is a fragmentary sectional view taken within the boundary of the circumscribing circle 4 of FIG. 3 and illustrates the flexed shape of the bottom in full lines.

With further reference to FIGS. 3 and 4, therefore, when internal pressure is exerted upon the bottom 12 of a fully closed and sealed can generally in the manner indicated by the arrows, the planar section 22 as well as the central portion of the bottom made up of sections 16, 18 and 20 will all flex outwardly. This flexing takes place in a controlled fashion and in the manner illustrated in dotted lines in FIG. 3 and full lines in FIG. 4 until as noted previously the stabilizing ring portion 26 of bottom 12 moves beyond the plane S that can be projected by the bottom surface 28 of planar section 22 and out to a new plane S' that can be projected by ring portion 26 and then into contact with the surface upon which the can is to rest. Control of the dimensions and shape of depression 16 along with the amount of coining or work hardening of section 24 all help to control the flexibility of the can bottom and prevent any undesired and excessive outward bulging of the can bottom. When the can is opened and internal pressure relieved, the bottom of the can will relax and, as the overall bottom tends to collapse and flex inwardly, sections 20 and 22 will tend to return to their as-fabricated positions, with stabilizing ring portion 26 tending to retract inwardly of the aforesaid plane S' while the outer secondary stabilizing ring portion 32 formed at the junction of surface 28 and coined section 24 will seek to contact the support and become the primary support base for the can 10 adjacent coined section 24.

The aforesaid inward flexing and retraction will tend to occur even in cases where coined section 24 may receive a slight permanent deformation outwardly due to the outward distention of section 20 by the internal pressures within the sealed can. In other words, depending upon the particular metal and the alloy and temper thereof used for can body 10 there may or may not be a slight outward permanent plastic deformation of coined section 24 under pressure whereby stabilizing ring portion 26 will not be fully restored to its initial as-fabricated position of rest upon the relaxation of internal pressure, even though it will always seek to be restored to such an initial position of rest.

In a further advantageous embodiment of the invention, secondary stabilizing ring portion 32 functions in a unique fashion in preventing tipping of the container because even when the unopened and filled container is under pressure ring portion 32 will be located slightly inwardly but a few fractions of an inch from the level of primary stabilizing ring portion 26. In other words, should the sealed and filled container body tend to tip for one or more reasons, it will almost immediately come into contact with a part of secondary stabilizing ring 32 and be restored to a position of stability unless the tipping force is so great that the pivotal action of the can is severe enough to cause the can to tip past both secondary stabilizing ring portion 32 and the third stabilizing ring portion 34 formed at the juncture 30 of bottom 12 and sidewall 14 and all concentrically arranged relative to ring portion 26.

During the flexing of the can bottom, it is to be understood that the amount or thickness of metal present at the point of merger or juncture between section 22 and wall 14 will determine the degree of stiffness of this primary hinge point for bottom 12. In a preferred embodiment of the invention enough metal should be present to allow section 22 to distend slightly outwardly under pressure followed substantially immediately by a slightly further outward distention of the central part of the can bottom. The area of this central part of the can bottom and containing sections 16, 18 and 20 is indicated by the letter B of FIGS. 1 and 2, the bottom area formed by depressed segments 16 and 18 by the letter A and the overall area of can bottom by the letter C. In the flexing of bottom 12, juncture point 30 can be considered a first or primary hinge and section 24 a secondary hinge.

From the above description, it will be seen that the shallow structure and the lack of severe deformation of the can bottom, except in the selectively thinned or coined area 24 mean that a minimal amount of metal material is required in the bottom of the can to form the various concentrically disposed sections 24, 20, 18 and 16 and sidewall 14 in accordance with a given can requirement as to strength and capacity. For example, whereas in the past a commercially acceptable 12 ounce beverage can made from a 3004 series aluminum alloy as designated by the Aluminum Association and of an extra hard or H-19 temper would ordinarily have a nominal bottom wall thickness of 0.016 inch plus or minus the usual tolerances, the same 12 ounce can provided with the instant bottom design, and when made from the same aluminum alloy and temper may now be made with a nominal bottom wall thickness of 0.014 inch. In such instance, the controlled coined area 24 may have a thickness of about 0.010 inch in the thinnest part thereof and the top of the button-like depression 16 which ordinarily is the thinnest overall part of the bottom can have a thickness of about 0.009 inch.

Figure 5:
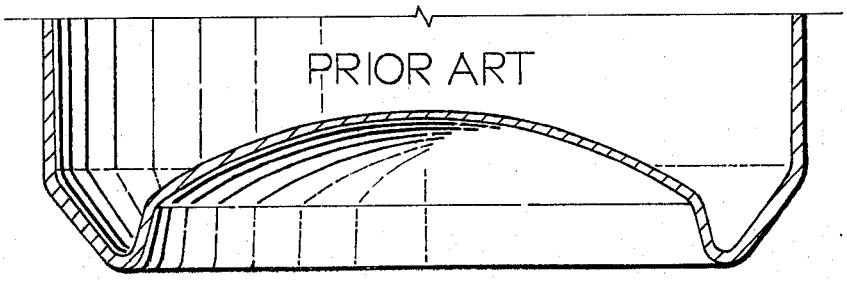
FIG. 5 is a sectional view of the bottom and lower sidewall of a prior art container provided with a conventional concavely domed bottom panel or end.

Although the savings in metal material due to the improved bottom structure is believed to be significant, additional savings can be realized in manufacturing costs by the use of simplified washing and can coating procedures required for a can of the instant invention. For example, in contrast to the expensive procedures required to uniformly coat the intricate inside bottom surface of the can of FIG. 5, the configuration of the bottom of the instant can lends itself to being washed and coated by relatively uncomplicated equipment and methods as well as to being formed on a draw and iron press.

An advantageous embodiment of the invention has been described.

What is claimed is:

1. A seamless metal container body comprised of a sidewall and a bottom having controlled distention characteristics and formed integrally with the lower extremity of the said sidewall, said bottom having a centrally and inwardly disposed relatively shallow dome-like depression the outer peripheral edge of which terminates in a slight upwardly and outwardly projecting dished section, the outer extremity of the said dished section merging with a generally planar section, and the outer periphery of said planar section merging with the sidewall, said planar section constituting at least a substantial part of the total cross-sectional area of the said bottom and the point of mergence of the dished section and said generally planar section being comprised of a selectively thinned and work hardened portion having distortion resistant hoop-like strength characteristics, and said last mentioned portion also acting as a relatively stiff hinge about which the central part of the container bottom including the dished section is allowed to flex selectively outwardly beyond the outermost plane of the outer surface of the planar section when the overall bottom flexes and is distended outwardly a controlled amount under the influence of internal pressures within the container body.

2. A container body as set forth in claim 1, wherein said work hardened portion comprises a coined portion.

3. A container body as set forth in claim 1 wherein said dished section has a substantially inverted frusto-conical configuration.

4. A container body as set forth in claim 1 wherein the dome-like depression has a substantially spherical configuration.

5. A container body as set forth in claim 1, wherein the said dome-like depression has a partial configuration approximating a segment of sphere and a planar section joined to the terminal bottom of the spherical segment.

6. A container body as set forth in claim 1 and made in the form of a work hardened drawn and ironed can body.

7. A container body as set forth in claim 1 wherein said container body comprises a work hardened impact extruded container body.

8. A container body as set forth in claim 1 wherein said work hardened portion comprises a cross-sectionally curved and coined portion and said container body is a drawn and ironed container body.

9. A container body as set forth in claim 1 wherein said work hardened portion comprises a cross-sectionally curved and coined portion and said container body comprises an impact extruded container body.

10. A container body as set forth in claim 1 wherein said work hardened portion comprises a cross-sectionally curved and coined portion and the major surface area of said bottom is provided by said planar section.

11. A seamless cylindrical metal container body provided with a sidewall and a bottom having controlled distention characteristics and formed integrally with the lower extremity of the said sidewall, said bottom being comprised of a centrally and inwardly disposed relatively shallow dome-like depression which has at least in part a substantially spherical configuration and the outer peripheral edge of which terminates in a slightly upwardly and outwardly projecting dished section, a generally planar section which merges at its outer periphery with the said sidewall, said planar section constituting a major part of the overall area of said bottom of the container body and a selectively work hardened and thinned cross-sectionally curved portion joining and integrating said dished section with said planar section, said curved portion also acting in the manner of a relatively stiff secondary hinge about which the central part of the container bottom including said dished section flexes outwardly and beyond the outermost plane of the outer surface of the planar section when the overall bottom flexes and is distended outwardly a controlled amount under the influence of internal pressures within the container body.

12. A container body as set forth in claim 11 wherein the dished section has a slight inverted frusto-conicial configuration.

13. A container body as set forth in claim 11 wherein the thinned curved portion comprises a coined section and the container body is made in the form of an impact extruded container body.

14. A container body as set forth in claim 11 wherein the areas of joindure between the dished section and the dome-like depression and said dished section and said planar section also form primary and secondary stabilizing ring portions.

15. The container body as set forth in claim 11 wherein the thinned curved portion comprises a coined section.

16. A container body as set forth in claim 15 wherein said dished section is frusto-conical.

17. A container body as set forth in claim 11 wherein said thinned curved portion is comprised of a coined section, said dished section has a slight inverted frusto-conical configuration and said container body is a drawn and ironed container body made from a hard tempered aluminum base alloy.

18. A container body as set forth in claim 17, wherein the areas of joindure between the dished and the dome-like sections and the dished and planar sections also form primary and secondary stabilizing ring portions.

19. A container body as set forth in claim 11 wherein the thinned curved portion comprises a coined section and wherein the container body is made in the form of a drawn and ironed container body.

20. A container body as set forth in claim 19 wherein the areas of joindure between the dished and dome-like depression and the dished and planar sections also form primary and secondary stabilizing ring portions.

21. A seamless drawn and ironed cylindrical container body of a hard tempered aluminum base alloy provided with a sidewall and a bottom having controlled distention characteristics and formed integrally with the lower extremity of the said sidewall, said bottom being comprised of a centrally and inwardly disposed relatively shallow dome-like depression which has at least in part a substantially spherical configuration and a planar base the outer peripheral edge of which terminates in a slightly upwardly and outwardly projecting dished section, a generally planar section which merges at its outer periphery with the said sidewall, said planar section constituting a major part of the overall area of said bottom of the container body and a selectively work hardened and thinned cross-sectionally and inwardly curved coined portion joining and integrating said dished section with said planar section, said curved portion also acting in the manner of a relatively stiff secondary hinge about which the central part of the bottom of the container body including said dished section flexes outwardly and beyond the outermost plane of the outer surface of the planar section when the overall bottom flexes and is distended outwardly a controlled amount under the influence of internal pressures within the container body.

* * * * *